US008720078B1

(12) United States Patent
Behbehani

(10) Patent No.: US 8,720,078 B1
(45) Date of Patent: May 13, 2014

(54) AUTOMATIC HAIR DRYER WITH FLUID DISPENSER

(71) Applicant: Fawzi Q.M.A.O.A. Behbehani, Salwa (KW)

(72) Inventor: Fawzi Q.M.A.O.A. Behbehani, Salwa (KW)

( * ) Notice: Subject to any disclaimer, the term of this patent is extended or adjusted under 35 U.S.C. 154(b) by 0 days.

(21) Appl. No.: 13/961,854

(22) Filed: Aug. 7, 2013

(51) Int. Cl.
*A45D 20/12* (2006.01)

(52) U.S. Cl.
USPC ..... 34/97

(58) Field of Classification Search
USPC ..... 34/96–99, 101, 283; 132/212; 392/379–385
See application file for complete search history.

(56) References Cited

U.S. PATENT DOCUMENTS

| | | | | |
|---|---|---|---|---|
| 2,481,262 | A * | 9/1949 | David Trompeter | 251/346 |
| 3,721,250 | A | 3/1973 | Walter et al. | |
| 3,889,693 | A | 6/1975 | Tanaka et al. | |
| 4,114,022 | A * | 9/1978 | Braulke, III | 392/383 |
| 4,327,278 | A | 4/1982 | Tomaro | |
| 4,490,602 | A * | 12/1984 | Ishihara | 392/379 |
| 5,448,499 | A * | 9/1995 | Palmer | 700/266 |
| 5,897,802 | A * | 4/1999 | Jones | 219/202 |
| 7,356,943 | B2 | 4/2008 | Behbehani | |
| 2006/0093337 | A1 | 5/2006 | Chan | |
| 2006/0201016 | A1 * | 9/2006 | Nakagawa et al. | 34/96 |
| 2009/0162253 | A1 * | 6/2009 | Porchia et al. | 422/124 |

* cited by examiner

*Primary Examiner* — Jiping Lu
(74) *Attorney, Agent, or Firm* — Richard C. Litman

(57) ABSTRACT

The automatic hair dryer with fluid dispenser is used for smoothing and drying hair. The fluid dispenser is in the form of a tank, which is built into the handle of the hair dryer. When filled with water, the dispenser is capable of discharging a water spray during the drying process and smoothing the hair as it dries, enabling the user to style the hair into any desired hairstyle. A comb is attached to the upper portion of the hair dryer housing, and a moisture sensor is positioned on the teeth of the comb for determining the wetness of the hair, adjusting the heat and intensity of the air being produced by the fan over the heating elements, which is then blown onto the hair. The wetter the hair, the faster and hotter the air will blow.

11 Claims, 10 Drawing Sheets

AUTOMATIC HAIR DRYER WITH FLUID DISPENSER

BACKGROUND OF THE INVENTION

1. Field of the Invention

The present invention relates to hair dryers, and particularly to an automatic hair dryer with a fluid dispenser for smoothing and drying a user's hair.

2. Description of the Related Art

A hair dryer or blow dryer is an electromechanical device designed to blow cool or hot air over wet or damp hair in order to accelerate the evaporation of water particles and dry the hair. Hair dryers are well known and widely used by barbers, beauticians and hair stylists, as well by individuals in their own homes and hotel rooms. Hair dryers are used to apply warm or hot air to dry an individual's hair. Hair dryers allow better control of the shape and style of hair by accelerating and controlling the formation of temporary hydrogen bonds inside each strand. These hydrogen bonds are very powerful (allowing for stronger hair shaping than even the sulfur bonds formed by permanent waving products), but are temporary and extremely vulnerable to humidity. They disappear with a single washing of the hair.

Most models use coils of wire that have a high electric resistivity and heat rapidly with an electric current. A fan (usually powered by a universal motor) blows ambient air past the hot coils resulting in heated air, effective for drying. The heating element in most hair dryers is a bare, coiled nichrome wire that is wrapped around insulating mica heating boards. Nichrome wire is used in heating elements because of two important properties, namely, it is a poor conductor of electricity and it does not oxidize when heated.

Many modern hair dryers now have "cool shot" buttons, which turn off the heater and just blow room temperature air while the button is pressed. Since warm and hot air create the style and remove excess moisture, the shot of cold air sets the style in place by sealing the hair shaft closed, preventing the hot style from wilting and adding super shine. This function is useful in helping to maintain the hairstyle by setting it. The cold air also reduces frizz and can help to bolster the smoothness of the hair.

Hair dryers are available with different attachments, such as diffusers, airflow concentrators and comb nozzle attachments. A diffuser is an attachment that is used on hair that is fine, colored, permed, or naturally curly. It works by diffusing the heat so that the hair dries more slowly at a cooler temperature. This makes it so that the hair is less likely to frizz, and it gives the hair more volume. An airflow concentrator does the exact opposite of a diffuser. It makes the end of the hair dryer narrower, and thus helps to concentrate the heat into one spot in order to make it dry more rapidly. The comb nozzle attachment is the same as the airflow concentrator, but it ends with comb-like teeth so that the user can dry the hair using just the dryer without a brush or comb.

Unless a hair dryer has a dual voltage option, it will only work in the United States, Canada and countries that use 110/120 V. Dual voltage dryers convert from 110/120 V to 220/240 V with a standard adapter, and then work almost anywhere in the world. Mini hair dryers and those with collapsible handles make great travel hair dryers because they are lightweight and do not take up precious suitcase space.

Thus, an automatic hair dryer with fluid dispenser solving the aforementioned problems is desired.

SUMMARY OF THE INVENTION

The automatic hair dryer has a built-in fluid dispenser and moisture sensor for smoothing and drying hair. The fluid dispenser is in the form of a tank located in the handle of the hair dryer. When filled with water, the dispenser is capable of discharging a water spray during the drying process and smoothing the hair as it dries, enabling the user to style the hair into any desired hairstyle. A comb is attached to the upper portion of the hair dryer housing, and a moisture sensor is positioned on the teeth of the comb for determining the wetness of the hair, adjusting the heat and intensity of the air being produced by the fan over the heating elements, and thus, being blown onto the hair. The wetter the hair, the faster and hotter the air will blow.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
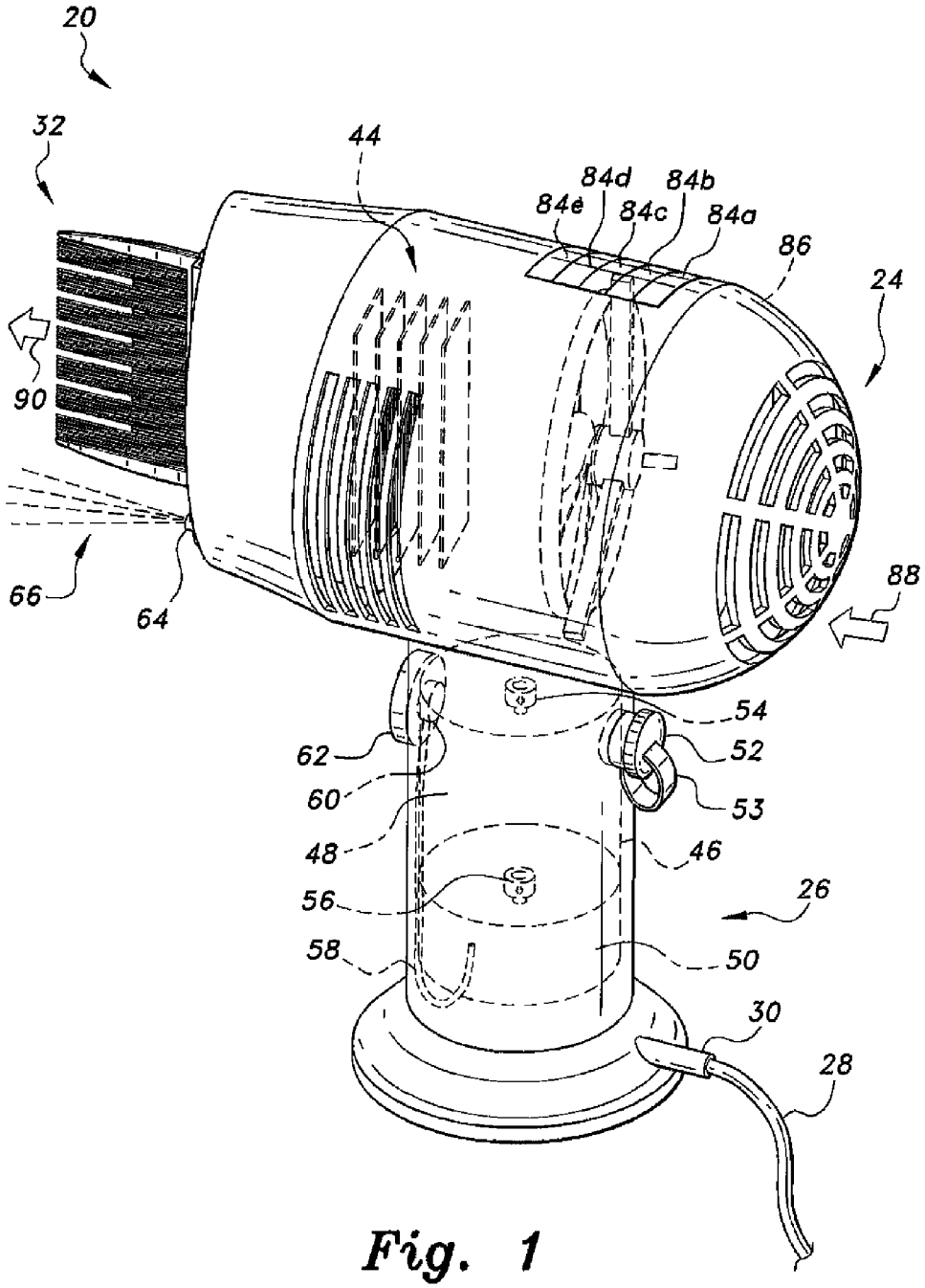
FIG. 1 is a side perspective view of an automatic hair dryer with fluid dispenser according to the present invention.

As shown in FIG. 1, the automatic hair dryer with fluid dispenser, designated generally as 20 in the drawings, is a handheld unit having an upper portion 24 and a base portion 26. The base portion is flat at the bottom so that it is capable of standing on a counter when not in use, and is shaped to conform to a user's hand for an ergonomic fit to function as the handle for the user to hold onto as she operates the hair dryer 20. The hair dryer 20 has a power cord 28 with a grommet 30, which includes a conventional plug that is plugged into an ordinary wall socket (not shown).

The hair dryer 20 has a built-in fluid dispenser in the form of a fluid tank 46 located in the base portion 26. When filled with water (or any other fluid), the tank 46 is capable of discharging a water (fluid) spray 66 during the drying process in order to smooth and restore the hair as it dries, enabling the user to style the hair into any desired hairstyle. As shown in FIGS. 7A through 7F, the fluid tank 46 has two chambers so that the tank 46 can supply water when the hair dryer 20 is at any angle, even when the tank 46 is practically empty. This is achieved because the tank 46 has an upper tank 48 and a lower tank 50 that are separated yet in fluid communication with one another via a fluid valve 56. Even when the upper tank 48 is empty, any remaining fluid will be trapped in the lower tank 50. The tank 46 itself is provided with a refill cap 52 that is capable of being twisted off, and has a retaining strap 53 so that the cap 52 is not lost during the refill process.

A flexible fluid supply hose 58 in fluid communication with the fluid tank 46 is connected to the bottom of lower tank 50 and includes a rubber bumper 60, which is adjacent to a fluid pump button 62, making it a completely sealed system. The pump button 62 is located externally on the base portion 26 for the user to operate an outlet spray nozzle 64 having a one-way nozzle. The nozzle 64 controls the fluid spray 66 from the fluid tank 46 by way of the supply hose 58. In order to pump fluid from tank 46, first the pump button 62 is depressed, which causes air from an air inlet 86 to be drawn through an air inlet valve 54 and forcing fluid from the upper tank 48 into the lower tank 50 via the fluid valve 56, and then ultimately from tank 46 through the supply hose 58. The spray nozzle 64 can spray fluid to the exact location where the user needs fluid to be.

Figure 7A:
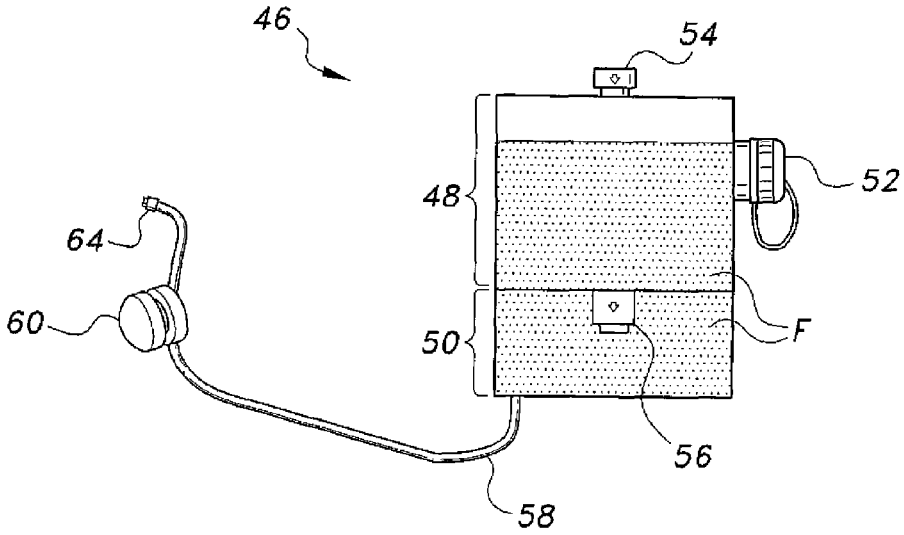
FIG. 7A is an exploded perspective view of the fluid tank of the automatic hair dryer with fluid dispenser of FIG. 1, shown when the upper tank is completely full.
Figure 7B:
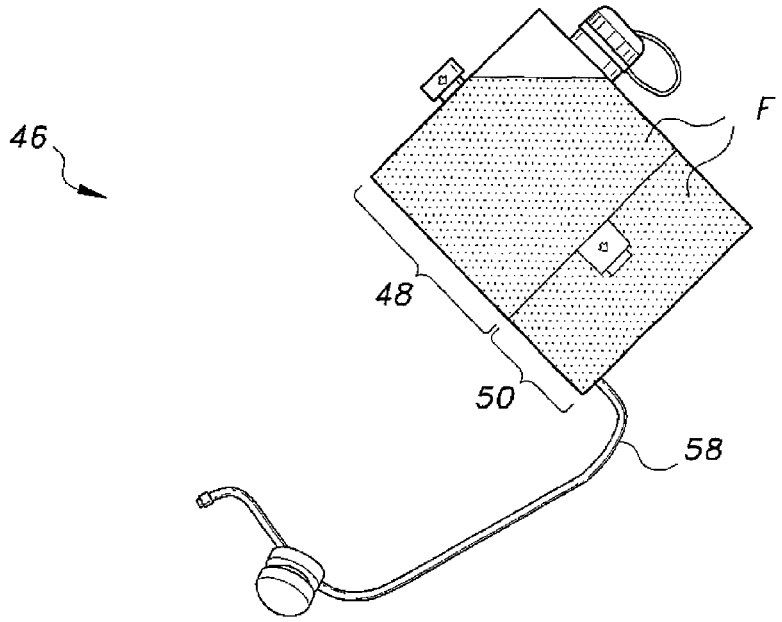
FIG. 7B is an exploded perspective view of the fluid tank of FIG. 7A, shown when the upper tank is completely full and the automatic hair dryer is tilted.
Figure 7C:
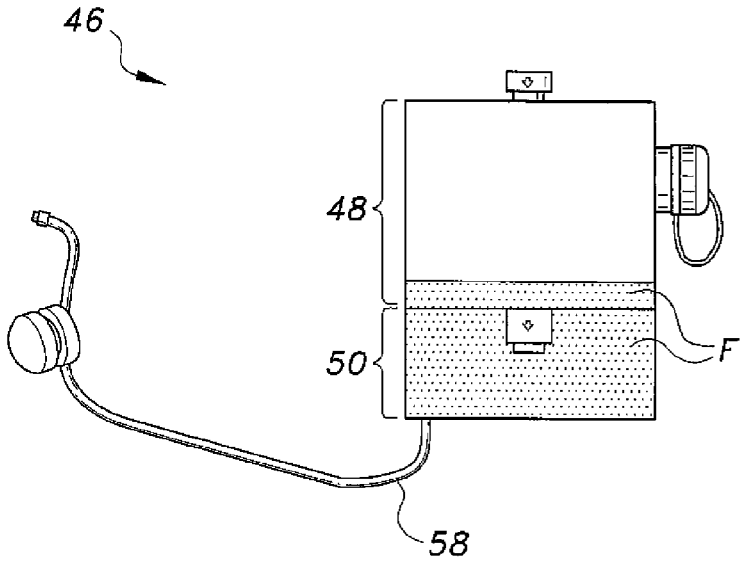
FIG. 7C is an exploded perspective view of the fluid tank of FIG. 7A, shown when the upper tank has a low water level.
Figure 7D:
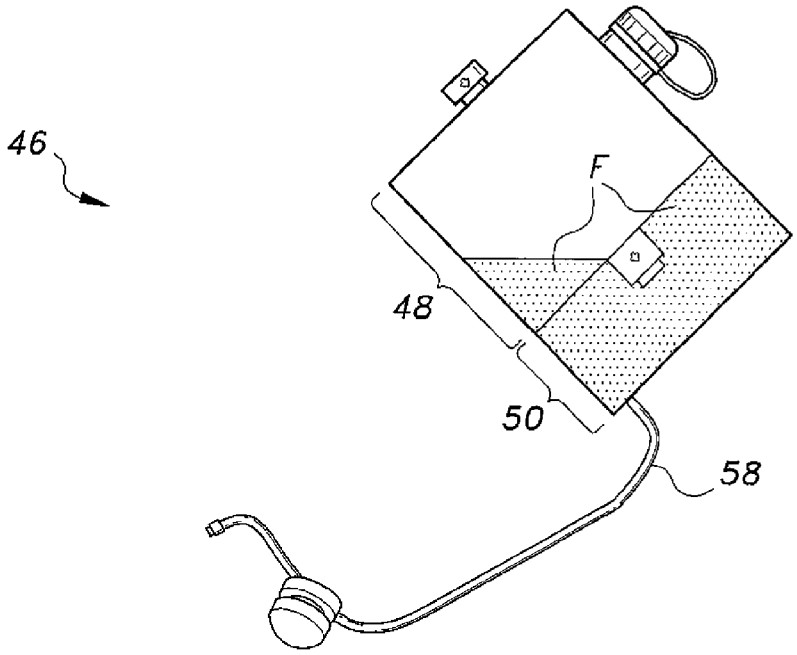
FIG. 7D is an exploded perspective view of the fluid tank of FIG. 7A, shown when the upper tank has a low water level and the automatic hair dryer is tilted.
Figure 7E:
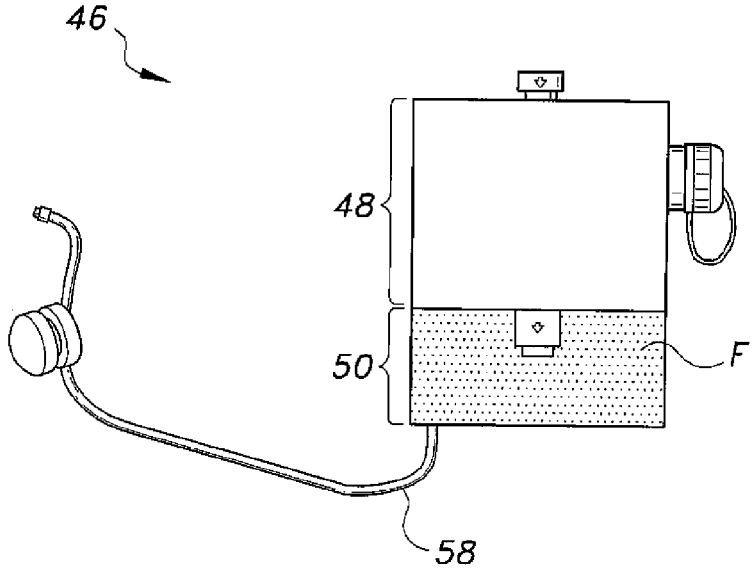
FIG. 7E is an exploded perspective view of the fluid tank of FIG. 7A, shown when the upper tank is completely empty.
Figure 7F:
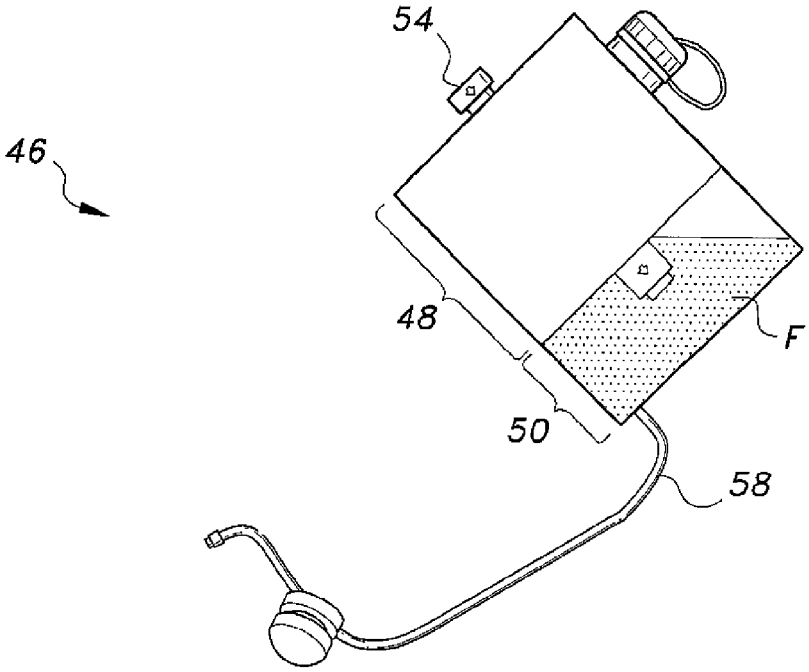
FIG. 7F is an exploded perspective view of the fluid tank of FIG. 7A, shown when the upper tank is completely empty and the automatic hair dryer is tilted.

FIG. 7A shows how the fluid level of fluid F appears when the upper tank 48 is full, and the hair dryer 20 is standing upright. FIG. 7B depicts the same upper tank 48 when the hair dryer 20 is held at an angle and the fluid level is affected. When the fluid level in tank 46 is low, and thus is low in the upper tank 48, as shown in FIG. 7C, the lower tank 50 still remains full. This is also true when the hair dryer 20 is tilted, as shown in FIG. 7D, since the fluid F is trapped in the lower tank 50 because the fluid valve 56 is a one-way valve, and fluid F can only enter the lower tank 50 via the valve 56. Fluid exits from the lower tank 50 through the hose 58. When the upper tank 48 is completely empty, fluid F may still be present in the fluid tank 46 if there is fluid remaining in the lower tank 50, as shown in FIG. 7E. FIG. 7F shows the fluid level as it would appear when the hair dryer 20 is being held at an angle, and the fluid F trapped in the lower tank 50 reacts to the movement of the hair dryer 20 by the user.

Figure 2:
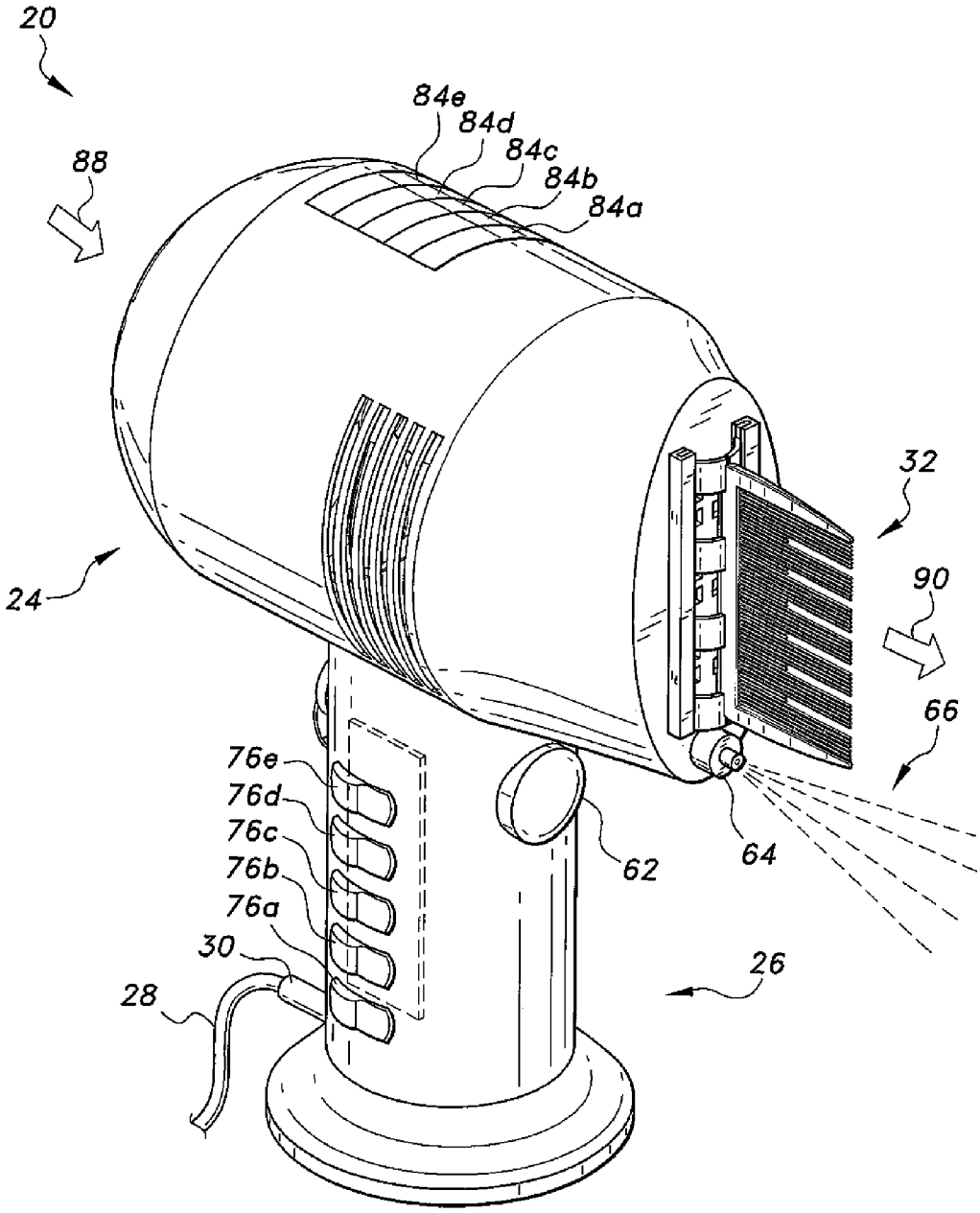
FIG. 2 is a rear perspective view of the automatic hair dryer with fluid dispenser of FIG. 1.

FIG. 2 shows how air flows through the upper portion 24 of the hair dryer 20 to heat and dry the hair. Air enters the upper portion 24 at air inlet 88 by means of a fan 86 and passes over the five different heating elements 44*a*-44*e* (shown in FIG. 4). Once the air is heated, it exits through an air outlet 90, which is positioned at the comb teeth 34 of comb 32. Moisture sensors 42 are positioned on the teeth 34, as shown in detail in FIG. 3, for determining the wetness of the hair, adjusting the heat and intensity of the air being produced by the fan 86 over the heating elements 44*a*-44*e*, and then being blown onto the hair. The wetter the hair, the faster and hotter the air will blow. The fan 86 is connected to a source 74 of electrical energy, such as a 120/240 Volt alternating current (V AC) power source 74 via a first power switch 78.

Figure 3:
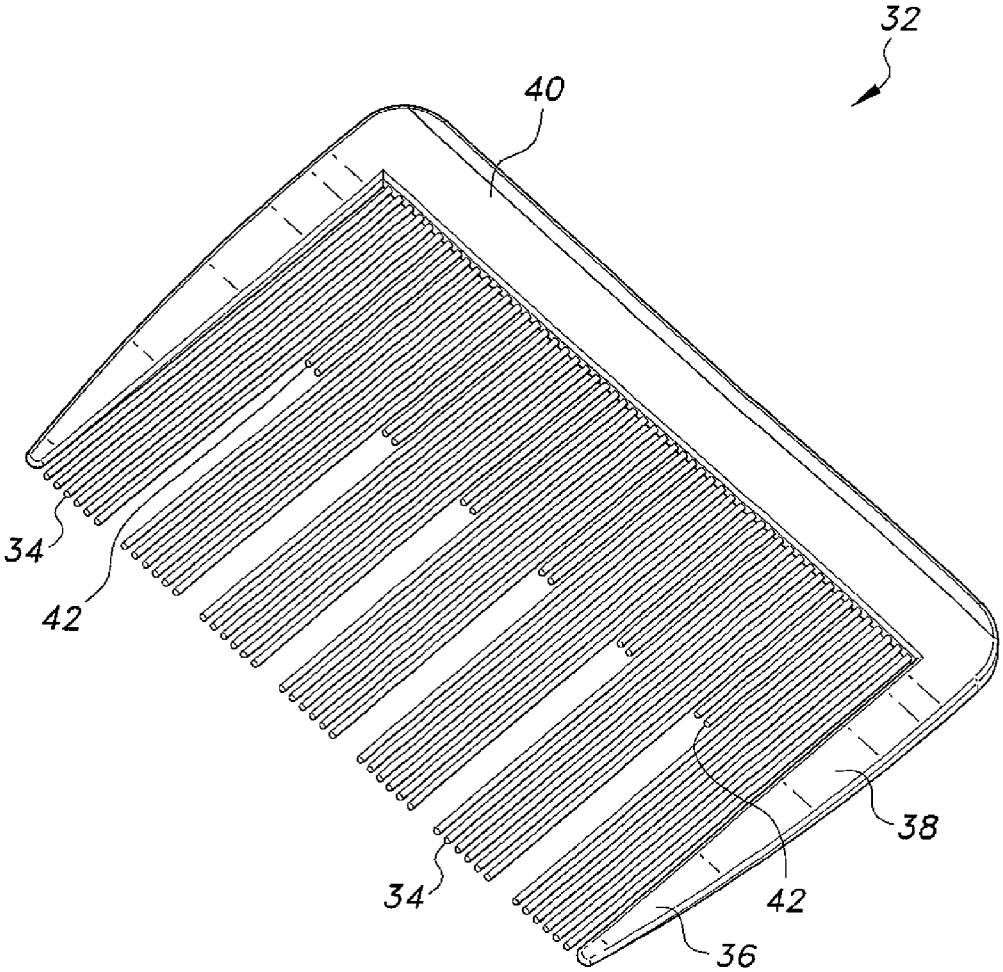
FIG. 3 is a perspective view of the comb attachable to the automatic hair dryer with fluid dispenser of FIG. 1, showing details thereof.

The comb 32, as diagrammatically shown in FIG. 3, has a rear solid portion 40, intermediate areas 38 and forward areas 36. Dispersed in the middle of these areas are comb teeth 34 and shorter moisture sensors 42 interspersed amongst the teeth 34.

Figure 4:
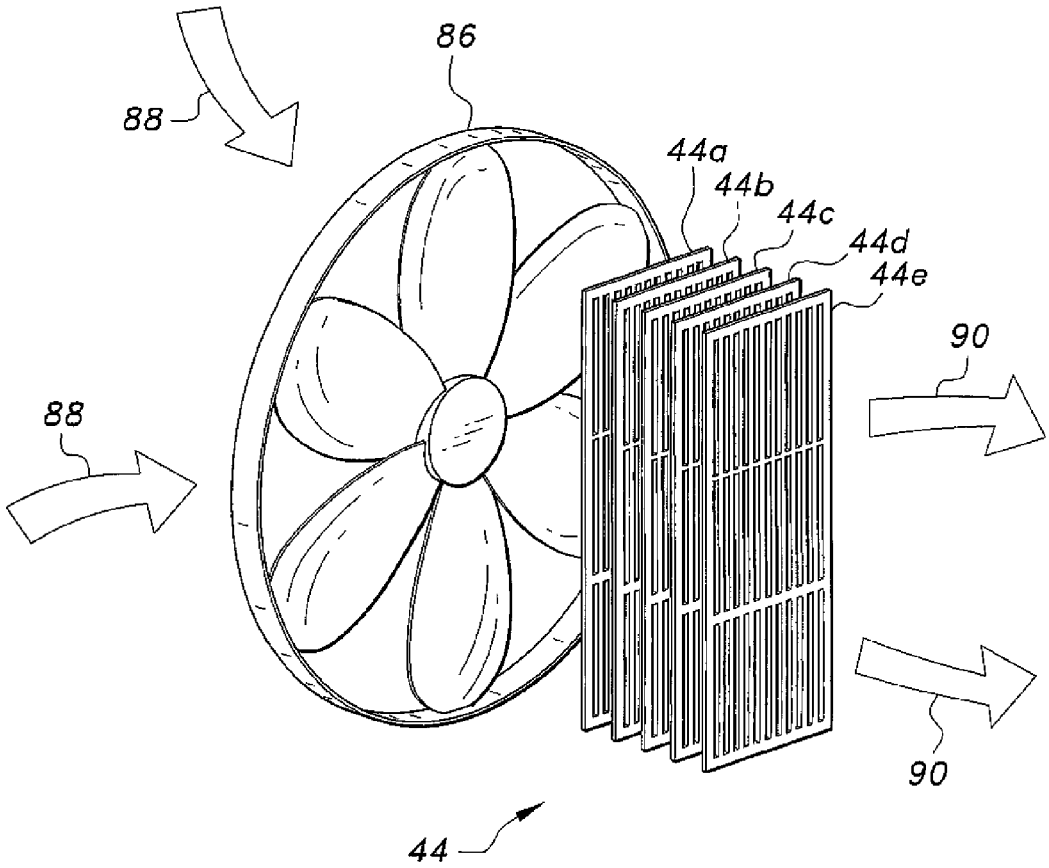
FIG. 4 is a diagrammatic perspective view of heating elements of the automatic hair dryer with fluid dispenser of FIG. 1.

As shown in FIG. 4, in a first embodiment, the heating elements 44 include a combination of five heating elements 44*a*-44*e*, the fan 86 pulling air in from the air inlet 88 and out through the air outlet 90. Each heating element 44*a*-44*e* has a power output of 200 Watts in order to speed up the transit time between ON and OFF when a user operates the hair dryer 20 for combing, styling and drying. As the moisture sensors 42 detect the moisture level of the hair, the heating element 44*a* will come on first, heating element 44*b* second, and so on, in sequence. This results in a quicker adjustment in temperature in each element as the moisture level in the hair changes. The hair dryer 20 also contains a conventional delay circuit 82 so that the heating elements 44 continue to operate for a short period of time when the comb 32 is out of contact with the hair, so that the hair dryer 20 does not turn off every time the user switches positions.

Figure 5A:
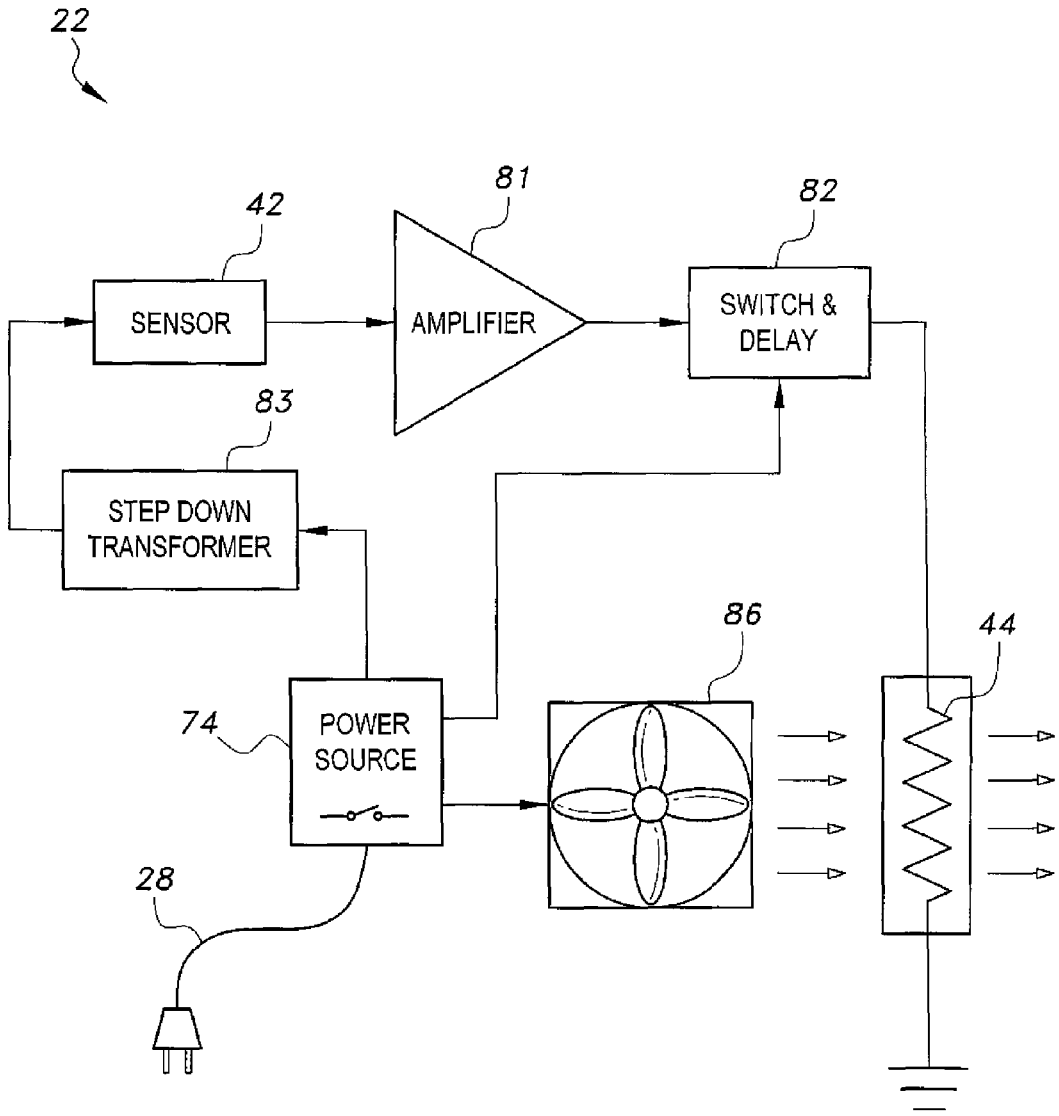
FIG. 5A is a block diagram of the electronic circuit of the automatic hair dryer with fluid dispenser of FIG. 1.

FIG. 5A is a block diagram that illustrates an exemplary electrical circuit. The hair dryer 20 has an electrical control circuit 22 with two power switches 78, 80. The first power switch 78 is used for connecting the fan 86 to the 120/240 V AC power source 74 when the hair dryer 20 is turned ON, and a second power switch 80 for connecting the heating elements 44 to the power source 74 when the moisture sensors 42 are contacted by wet hair.

The heating elements 44*a*-44*e* are turned on when the first power switch 78 is turned to the ON position, which activates the fan 86, and when the moisture sensor 42 senses moisture in the air. The sensor 42 is provided 12-Volt DC power by a step-down transformer 83 and is connected to the first power switch 78. The step-down transformer provides 12-Volt DC power to the sensor 42. When the sensor 42 senses moisture in a user's hair, a signal is sent to an amplifier 81. An amplified signal is fed to the second power switch 80, which turns the second power switch 80 to an ON position so that the heating elements 44*a*, 44*b*, etc., are energized, depending upon the amount of moisture detected. Therefore, the fan 86 blows air across the heating elements 44 and into a user's hair as the comb 32 passes through the wet hair. Then, when the sensor 42 fails to detect a predetermined amount of moisture in the hair, an amplified signal turns the second power switch 80 to an OFF position so that relatively cool air is used in the final styling.

Figure 5B:
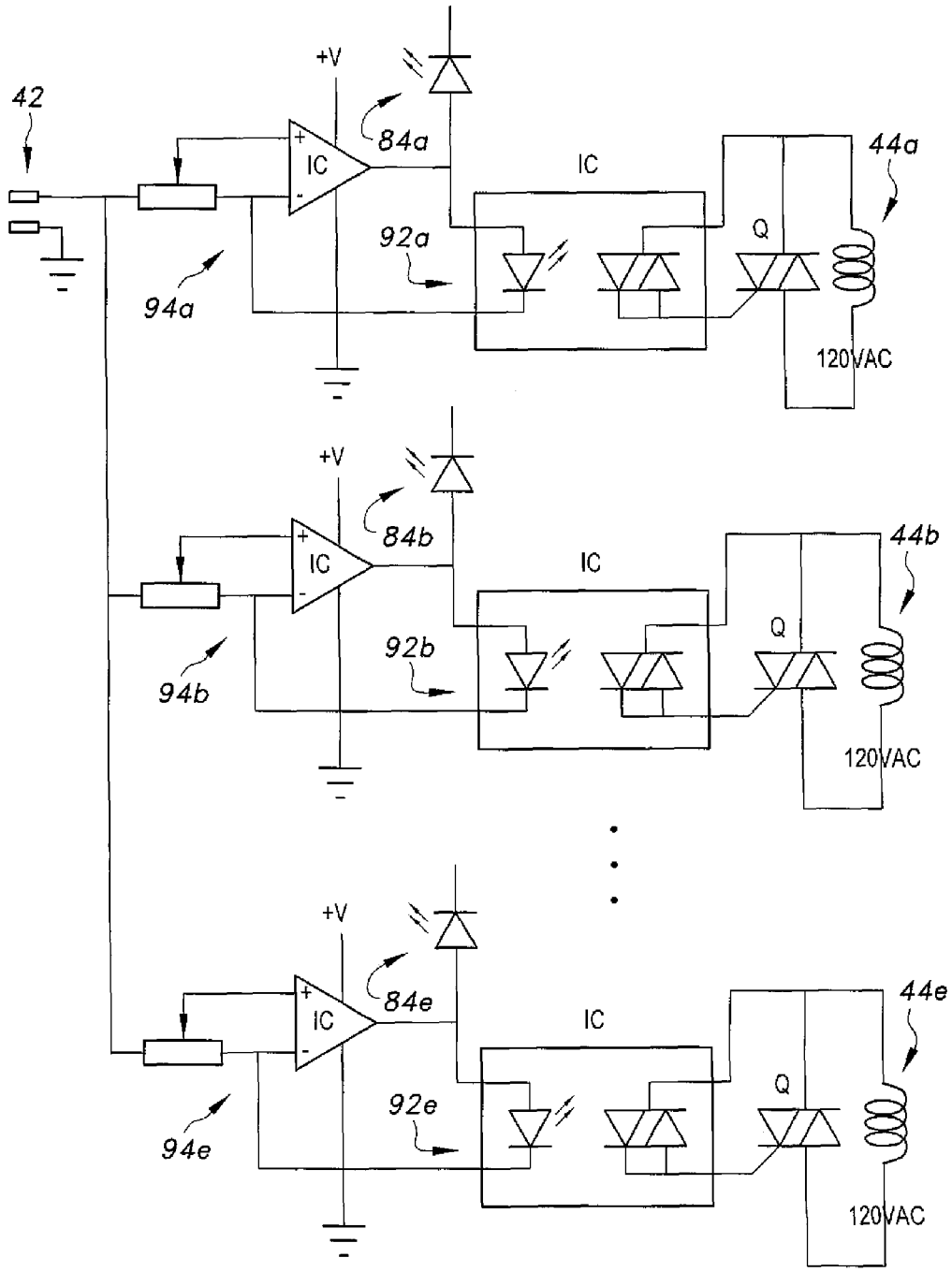
FIG. 5B is a schematic diagram of the electronic circuit of a moisture probe and heating elements of the automatic hair dryer with fluid dispenser of FIG. 1.

As shown in FIG. 5B, a moisture sensor 42 is connected to the each of the five heating elements 44*a*, 44*b*, etc. which have corresponding IC comparators 92*a*, 92*b*, etc., which have corresponding comparator input resistor values 94*a*, 94*b*, etc. Each of the five IC comparators 92*a*-92*e* are used to operate each of the five heating elements 44*a*-44*e* according to the amount of humidity in the hair as determined by the moisture sensor 42.

As each of the heating elements 44*a*-44*e* starts to heat up, the air of the hair dryer 20 will start to get hotter. LED indicator lights 84 corresponding to the heat intensity of the hair dryer air will light up on the upper portion 24. Yellow LED indicator 84*a*, for the coolest setting, lights up when only heating element 44*a* is activated. Dark yellow LED indicator 84*b*, for the warm setting, lights up when heating element 44*b* is activated. When heating element 44*c* is activated, orange LED indicator 84*c* turns on. The hottest settings are dark orange 84d and red 84*e* LED indicators, which correspond to heating elements 44*e*, 44*e*, respectively. There are five power buttons 76*a*-76*e* (as shown in FIG. 2) that correspond to these settings as well, in the event that a user would like to override the automatic setting and use a heat setting manually.

Alternatively, the hair dryer may have ten heating elements disposed in two groups 98*a*, 98*b* of five elements each 44*a*-

Figure 6:
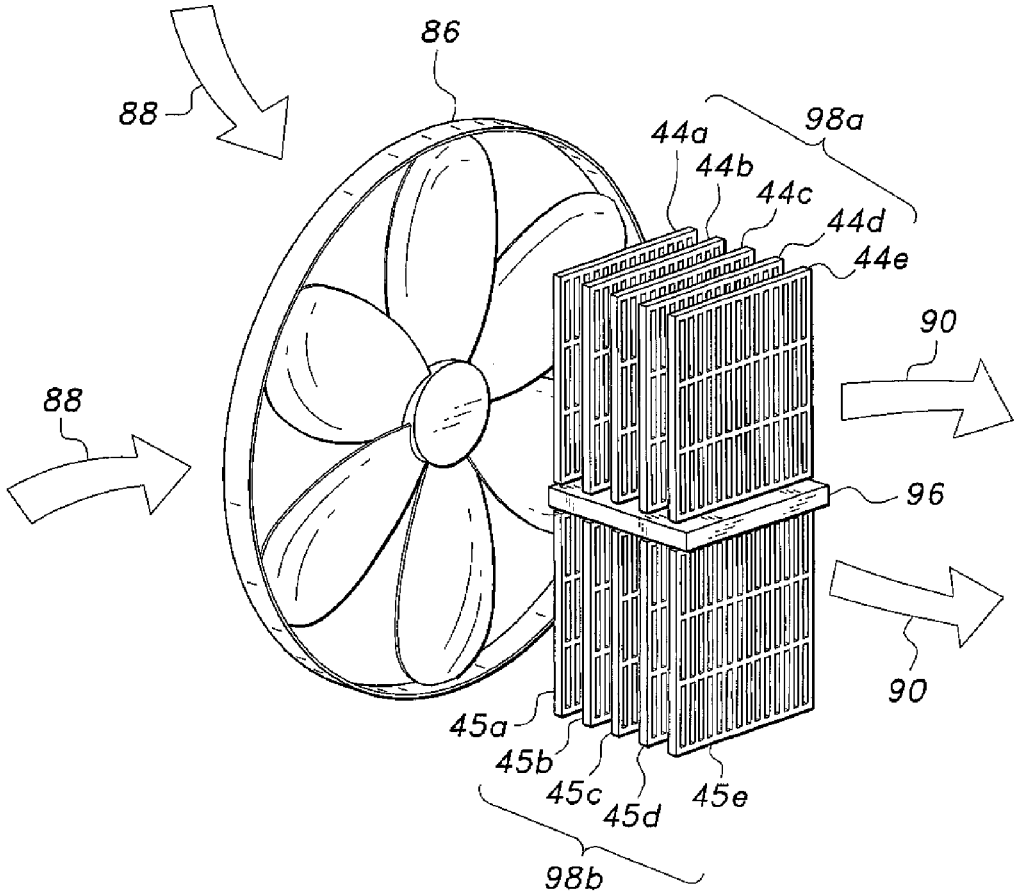
FIG. 6 is a diagrammatic illustration of heating elements for an alternative embodiment of an automatic hair dryer with fluid dispenser according to the present invention.

44*e*, and 45*a*-45*e*, respectively, as shown in FIG. 6. A partition 96 separates group 98*a* and group 98*b* from one another. Group 98*a* works as an independent hair dryer, just as group 98*b* works independently. This technique is a more accurate way to distribute heat in a different area. However, still only a single fan 86 will be utilized.

It is to be understood that the present invention is not limited to the embodiments described above, but encompasses any and all embodiments within the scope of the following claims.

I claim:

1. An automatic hair dryer with fluid dispenser, comprising:

a housing having an upper portion and a base portion, the upper portion having an air inlet and an air outlet formed therethrough;

a comb attached to an outer edge of the housing on the upper portion adjacent the air outlet, the comb having a plurality of forwardly extending teeth and a rear solid area fixed to the upper portion;

a fan disposed within the upper portion adjacent to the air inlet;

at least one heating element disposed within the upper portion adjacent to the fan and the air inlet, the fan selectively blowing air across the at least one heating element;

a moisture sensor having a plurality of probes disposed between the teeth of the comb, the probes being shorter than the teeth;

a fluid tank disposed in the base portion of the housing;

wherein the fluid tank including an upper tank having an air inlet valve, a lower tank having a fluid valve, and a refill cap including a retaining strap, the refill cap being selectively removed from the upper tank and tethered by the retaining strap;

whereby the upper tank is selectively refilled with liquid via the removal of the refill cap, and the lower tank is constantly filled from the upper tank via the fluid valve;

a flexible fluid supply hose in fluid communication with the fluid tank;

an outlet spray nozzle; and a fluid pump button disposed on the base portion being externally accessible, and causing fluid flow from the fluid tank to the spray nozzle when the fluid pump button is depressed.

2. The automatic hair dryer according to claim 1, further comprising an electrical control circuit including at least two power switches, including a first power switch for connecting the fan to a power source when the automatic hair dryer is turned on and a second power switch for connecting the at least one heating element to the power source when the moisture sensor is contacted by wet hair.

3. The automatic hair dryer according to claim 1, further comprising a delay circuit connected to the control circuit for continuing to operate the at least one heating element for a set period of time after the comb is out of contact with the hair.

4. The automatic hair dryer according to claim 1, wherein the at least one heating element comprises five heating elements, each of the heating elements having a power output of 200 Watts.

5. The automatic hair dryer according to claim 4, further comprising five comparators, each of the heating elements be connected to a corresponding one of the comparators, the comparators being configured to operate the heating elements according to the amount of humidity in the hair as measured by the moisture sensor.

6. The automatic hair dryer according to claim 5, further comprising five LED indicator lights connected to the five heating elements.

7. The automatic hair dryer according to claim 6, wherein each of the five LED indicator lights has a distinct color.

8. The automatic hair dryer according to claim 1, wherein the at least one heating element comprises ten heating elements.

9. The automatic hair dryer according to claim 8, wherein the ten heating elements comprise two groups of five heating elements each.

10. The automatic hair dryer with fluid dispenser according to claim 9, further comprising a partition between the two groups of five heating elements.

11. The automatic hair dryer according to claim 1, the outlet spray nozzle including a one-way nozzle, the outlet spray nozzle directing one-way fluid spray from the fluid tank when the fluid pump button is depressed.

* * * * *